US007080884B2

(12) United States Patent
Daeschle et al.

(10) Patent No.: US 7,080,884 B2
(45) Date of Patent: Jul. 25, 2006

(54) CHAIR WITH RAPIDLY ADJUSTABLE ENERGY STORING DEVICE

(75) Inventors: Kurt Daeschle, Billafingen (DE); Joachim Steinmann, Hohenfels (DE)

(73) Assignee: Klober GmbH (DE)

( * ) Notice: Subject to any disclaimer, the term of this patent is extended or adjusted under 35 U.S.C. 154(b) by 349 days.

(21) Appl. No.: 10/612,134

(22) Filed: Jul. 2, 2003

(65) Prior Publication Data

US 2004/0140702 A1 Jul. 22, 2004

(30) Foreign Application Priority Data

Jan. 22, 2003 (DE) ..... 103 02 208

(51) Int. Cl.
*A47C 1/024* (2006.01)

(52) U.S. Cl. ..... 297/303.4; 297/300.8; 297/303.5

(58) Field of Classification Search ..... 297/300.7, 297/300.8, 301.6, 301.7, 303.4, 303.5
See application file for complete search history.

(56) References Cited

U.S. PATENT DOCUMENTS

| | | | | |
|---|---|---|---|---|
| 4,709,962 A | | 12/1987 | Steinmann | |
| 4,962,962 A | | 10/1990 | Machate et al. | |
| 5,026,117 A | * | 6/1991 | Faiks et al. | 297/300.7 X |
| 5,160,184 A | * | 11/1992 | Faiks et al. | 297/300.7 |

FOREIGN PATENT DOCUMENTS

| | | |
|---|---|---|
| DE | 198 10 768 A1 | 9/1999 |
| DE | 19810768 | 9/1999 |
| EP | 1258 211 A2 | 11/2002 |

* cited by examiner

*Primary Examiner*—Anthony D. Barfield
(74) *Attorney, Agent, or Firm*—Gordon & Rees LLP

(57) ABSTRACT

A working chair with adjustable backrest support pre-set tension is described, in which a swiveling backrest support is positioned on a seat part, the backrest support being prestressed against the back of the user with a manually adjustable pre-set tension of an energy storing device. The front end of the energy storing device is rotatably mounted on a free, swiveling end of a guide bar close to the seat edge, and the rear end of the energy storing device is coupled to a free, swiveling end of the backrest support at a contact point which is designed to be adjustable and detectable.

10 Claims, 6 Drawing Sheets

CHAIR WITH RAPIDLY ADJUSTABLE ENERGY STORING DEVICE

BACKGROUND OF THE INVENTION

The present invention relates to a chair having a backrest support biased or stressed against the back of a user with an energy storing device having a manually adjustable pre-set tension.

A chair of this type is described in European Patent Application 0 277 474 A1, in which the seat part is height-adjustably mounted on the seat support against the prestress of a spring element by means of a parallelogram guide bar arrangement. The backrest support is mounted on the seat support such that it can swivel, such that the backrest support is pivoted against the prestressing force of the spring element. However, it is not possible to manually influence or adjust the prestressing force of the spring element.

In German Patent Application 198 10 768 A1, another synchronizing mechanism is known, in which there is an energy storing device, not prestressed by the backrest support, in the form of a helical spring. In this known arrangement, the prestress of the helical spring may be changed through a mechanical gear, which is impinged on by a button rotatable by hand. This involves a synchronizing mechanism, in which the spring resistance of the helical spring may be adjusted through a hand adjustment. When lowering the backrest support, the seat plate is guided backwards via a diagonal slot directed backwards, as a result of which the spring is stretched. The relatively difficult guide between the seat and the backrest support is a disadvantage, and furthermore, it is a further disadvantage that the manual adjustment of the spring prestressing force through a spur gear system is costly and prone to breakdowns.

SUMMARY OF THE INVENTION

The object of the present invention, therefore, is to further develop a chair with energy storing device adjustable by the user, such that a considerably simpler adjustment of the energy storing device may take place.

To achieve the task presented, the present invention is characterized in that the front end of the energy storing device is rotatably mounted on a free, swiveling end of a guide bar close to the seat edge and the rear end of the energy storing device is coupled to a free, swiveling end of the backrest support and that this contact point of the energy storing device is designed to be adjustable and detectable.

The advantage of the present invention over the background art is that a direct adjustment of the prestress of the energy storing device no longer takes place through a spur gear system or the like. Instead, the adjustment of the energy storing device takes place through a pivoting of the contact point of the energy storing device on the swiveling part of the backrest support.

For this purpose, in an exemplary embodiment of the invention, an interlocking element is positioned on the swiveling part of the backrest support, the interlocking element essentially comprising a toothed rack. The catching recesses of this toothed rack are turned against the energy storing device, which with an allocated spring guide and a tooth positioned on the rear end of the spring guide may be forced into engagement with the catching recesses of the toothed rack of the interlocking element.

The important thing is that the pivoting of the energy storing device (designed here as a helical spring) may be adjusted manually. For this purpose, there is a lever accessible from outside, which is connected in a rotationally fixed manner to a bracket that is positioned in a slot. The spring guide of the energy storing device is non-rigidly guided in this slot. If the lever is manually pivoted, the bracket and the slot worked into the bracket are pivoted, as a result of which the spring guide is adjusted in this slot and the spring is pivoted more or less via its front pivot bearing.

In this manner, a sensitive adjustment of the elasticity on the backrest support is possible because the toothed rack positioned on the interlocking element exhibits varied divisions. For example, a number from eight to thirty different catching recesses may be positioned on the length of the toothed rack, in which these catching recesses each have a combined effect with one or several teeth of the spring guide of the energy storing device.

Another important factor is that no lock is required for the pivoting of the manually pivotable lever because this involves an automatic catch of the adjusted position. So as soon as the end of the energy storing device on the side of the backrest support has engaged with its gear-tooth system into the allocated gear-tooth system on the interlocking element of the backrest support independently through the lowering of the backrest support, no other lock is needed for the manually swiveling lever. This consequently saves considerable construction and production costs.

Unlike the so-called "fully automatics" according to background art, in the present invention, it is no longer provided for the seat plate itself to be designed so that it pivots. It therefore does not cause any adjustment of the spring, but according to the present invention, the spring is changed in its point of application of force on the backrest support through a hand-adjustable lever. This considerably lowers production costs.

Up to now, it has been customary for the front end of the energy storing device (e.g., the helical spring) to support itself on a point of the seat support fixed to the housing. The present invention avoids this arrangement, and instead has the front end of the energy storing device or spring positioned on the swiveling part of a guide bar, which is positioned at the frontmost edge of the seat support.

This guide bar pivots in the same manner as the backrest support pivots when the user leans against the backrest support. Consequently, the front end of the energy storing device is still additionally prestressed against the rear end of the energy storing device on the side of the backrest, as a result of which an additional prestress of the energy storing device takes place. The energy storing device is therefore doubly prestressed when the backrest support is swiveled down, that is, once through the movement of the swiveling part on the seat, namely on the end of the energy storing device on the side of the backrest support, and the second time, the energy storing device is still additionally compressed when the front end of the energy storing device contacts the guide bar, which is likewise pivotable in direction of the backrest support that swings out backwards.

The present invention also provides for a pre-positioning of the ratchet tooth or of the ratchet teeth of the energy storing device to be done with respect to the toothed rack on the interlocking element. Such a pre-positioning always ensures that when swinging out the backrest support, a ratchet tooth of the energy storing device is always opposite an allocated catching recess on the interlocking element. Thus, unwanted contact noise and scraping noise are avoided when the ratchet connection is being made.

The present invention achieves this by having an index peg on the free, swiveling end of the energy storing device, which, spring-loaded, engages into an allocated indexing track. This indexing track therefore predetermines different pivoting angles of the energy storing device before this has actually engaged into the catching recess on the interlocking element. In this way, it is always ensured that the ratchet tooth in the energy storing device always lies opposite a corresponding catching recess on the interlocking element.

In another embodiment, the present invention also provides for a continuously variable lock since it is easily possible to execute the engagement between the energy storing device and the allocated interlocking element as a sliding guide, which can be bolted to certain points (for instance, by means of a cam).

This invention therefore provides a continuously adjustable engagement of the end of the energy storing device on the side of the backrest into the allocated interlocking element. A more sensitive, direct adjustment of the stress or biasing force on the backrest is provided.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
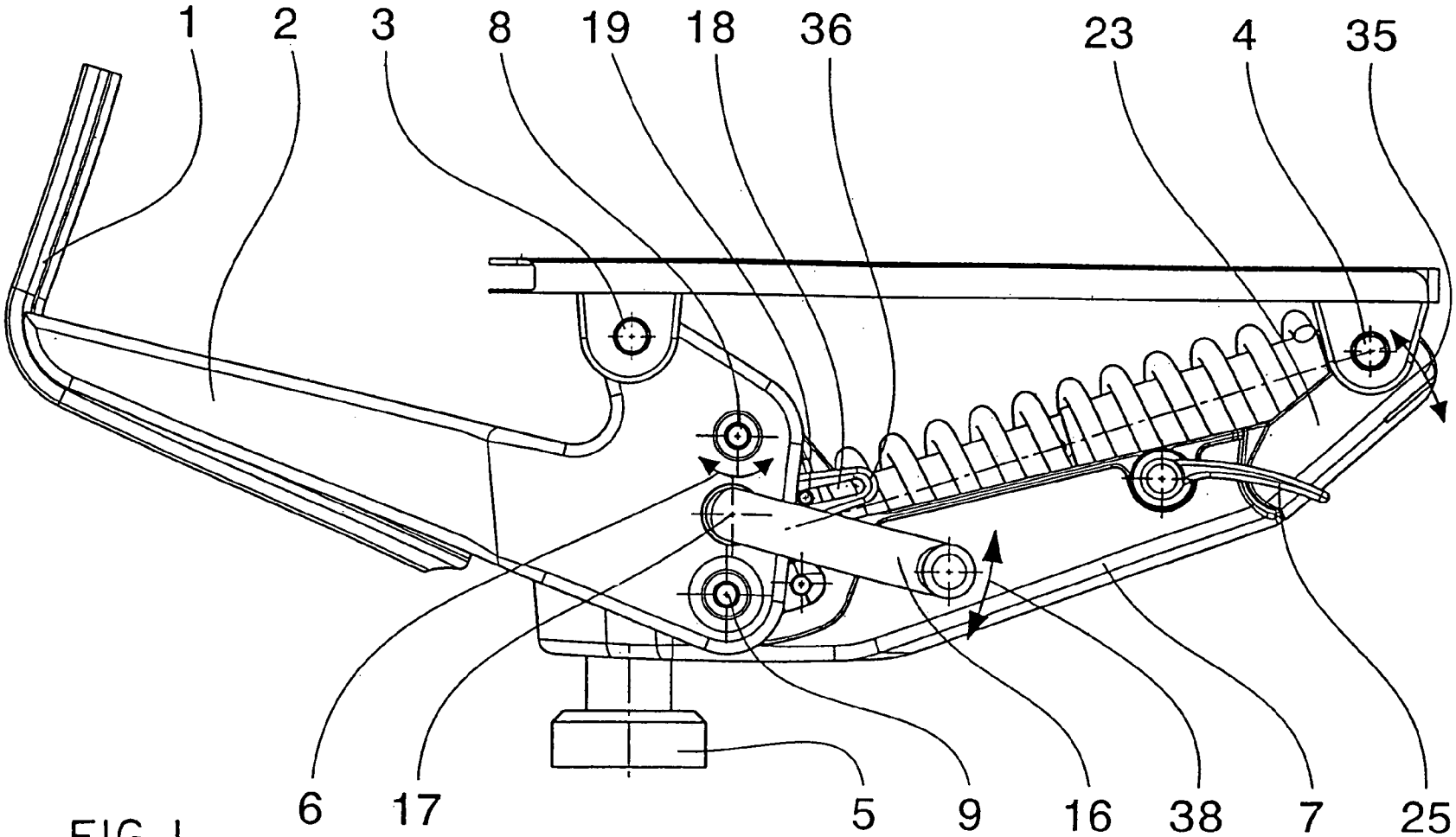
FIG. 1 is a side view of a seat and backrest support of a working chair, according to an exemplary embodiment of the invention.
Figure 2:
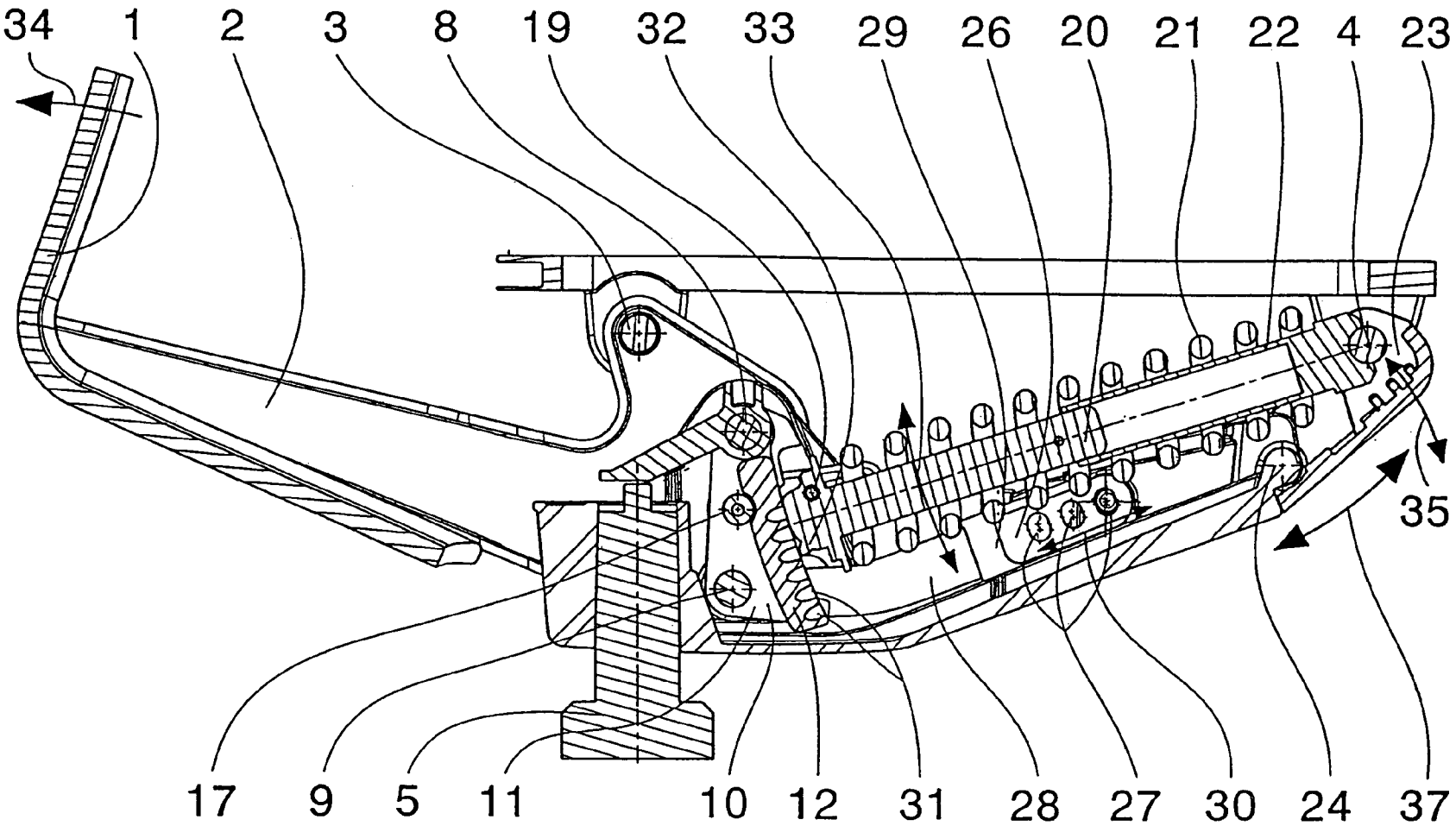
FIG. 2 is a central longitudinal section through the arrangement according to FIG. 1, illustrating a first tensioning position of the adjustment mechanism when the restoring force is on the middle setting.
Figure 3:
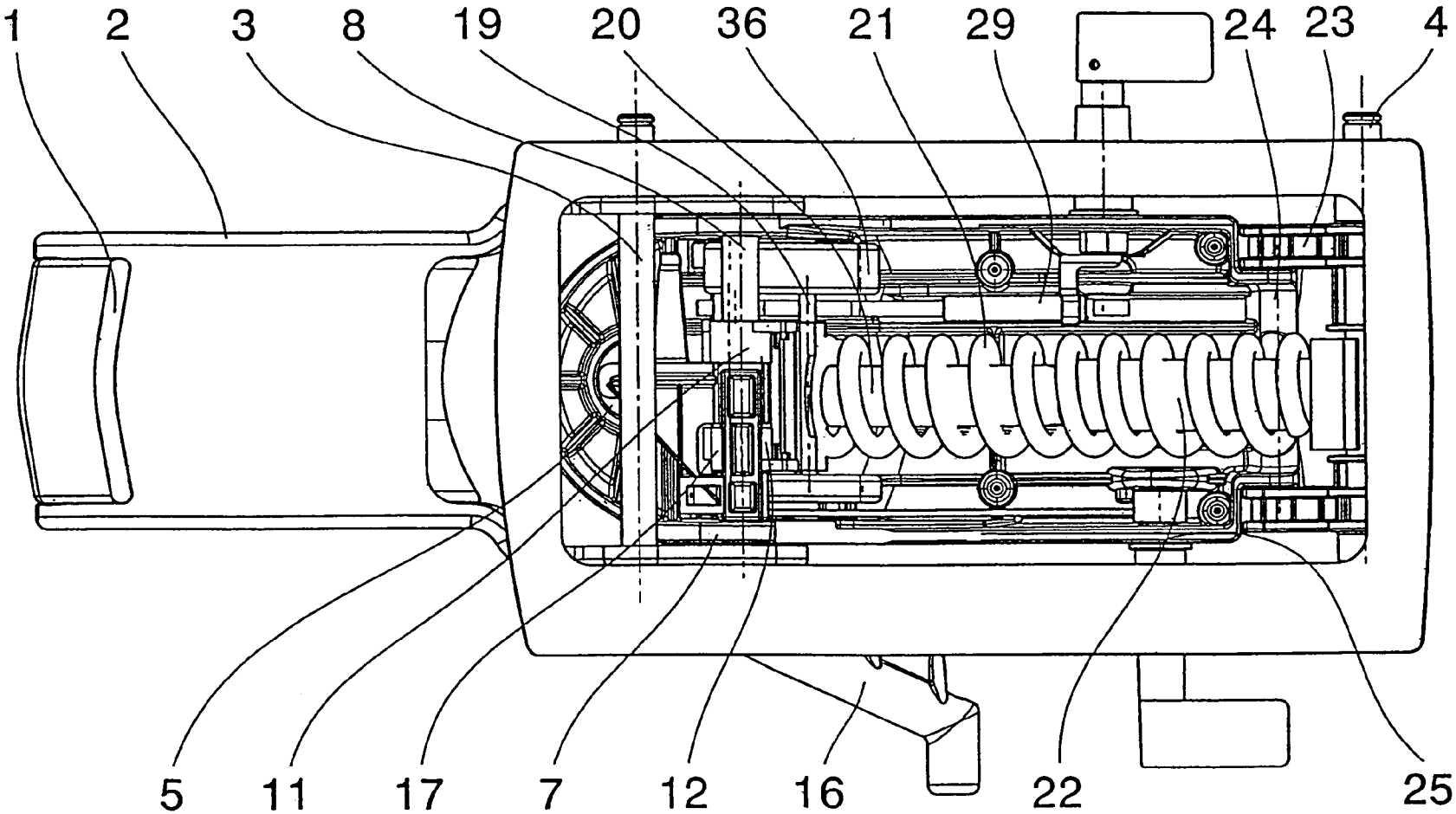
FIG. 3 is a top view of the arrangement of FIGS. 1 and 2.
Figure 4:
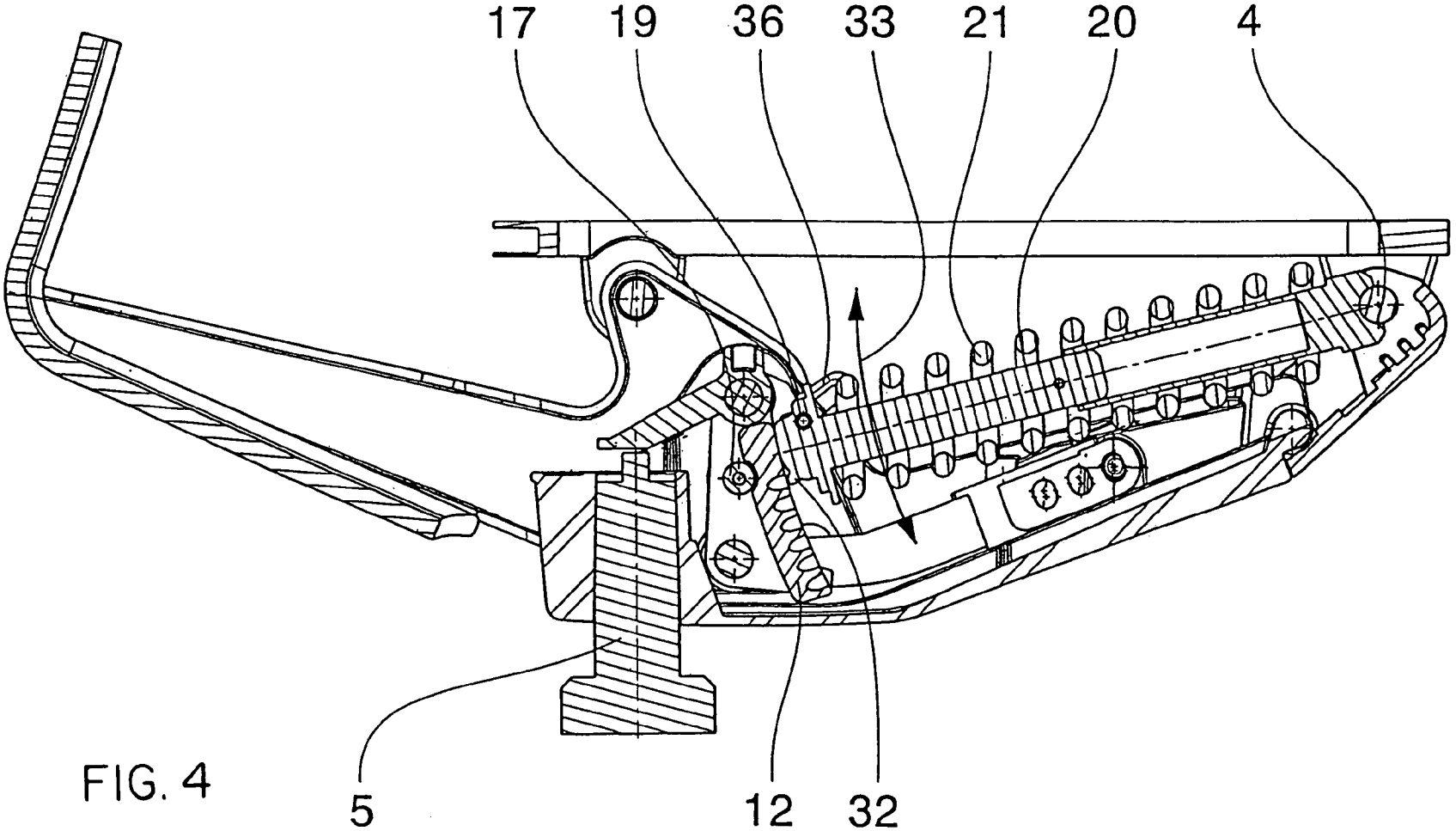
FIG. 4 is a sectional view similar to FIG. 2, illustrating a second tensioning position of the adjustment mechanism at the lightest adjustment of the restoring force.

In FIGS. 1 to 6, the base of a working or office-type chair is generally shown, which is made up of an air column 5, which is fastened in the seat support 7. A backrest support 1 holds the seat support 7. As illustrated in FIG. 3, the backrest support is coupled to seat support 7 via right and left brackets 2, such that it can swivel. To this end, particular bracket 2 is rotatably mounted in a bearing 8 on seat support 7.

Upper seat bearing 3 is for the swiveling housing of a seat plate, not illustrated further, which contacts this seat bearing 3 via a bracket, not illustrated further. The front end of the seat plate, not illustrated further, is fastened in a swiveling manner to a front seat bearing 4 via a bracket, not illustrated further. The brackets are rigidly connected to the seat plate.

The important thing is that there is a pivot bearing 24 on the front end of seat support 7, the pivot bearing accommodating a guide bar 23, which as a result is configured so that it can pivot in arrow directions 37 (FIG. 2) around this bearing 24, as best illustrated in FIGS. 1–3. As already explained at the start, the front end of the seat plate, not illustrated further, is accommodated in the front seat bearing 4, so that this front end with the appropriate guide bar 23 is configured such that it can pivot. When pivoting guide bar 23 around pivot bearing 24, even the seat plate, not illustrated further, is consequently pivoted around seat bearing 3.

According to FIGS. 1 and 3, backrest support 1 is in each case connected to a bracket 2, in which bracket 2 is accommodated in bearing 8. This results in a free, swiveling, lower part of bracket 2, in which a bearing 9 has been incorporated. This bearing 9 is the pivot bearing for an interlocking element 10. Interlocking element 10 is essentially made of two brackets 11 positioned parallel to one another, which essentially form a U-shaped element, in whose middle region a toothed rack 12 is positioned (see FIG. 2).

Interlocking element 10 is connected to bracket 2 in a fixed manner, and because of the movement of the backrest support in arrow direction 34, also makes the same movement, in which it pivots around bearing 8. Other parts are also mounted in bearing 9 on the bearing journal provided for this, in particular, the parts for a stopping plate 26 and a hand-adjustable lock for the pivotal adjustment.

In bracket 2, an axle 17 is also positioned in the free, swiveling part, with an operating lever 16 being accommodated in a swiveling manner in the axle (see FIGS. 1 and 3). This operating lever 16 is rigidly connected to a bracket 36, in which a slot 18 is incorporated, as best illustrated in FIG. 1.

A pilot pin 19 is non-rigidly accommodated in slot 18 so that pressure spring 21 is consequently freely adjustable. It should also be mentioned that instead of a helical spring, all other known energy storing devices may also be used, such as for example, pneumatic springs, hydraulic springs, elastomer springs, and the like. In the exemplary embodiment shown, the spring guide of pressure spring 21 is made up of a lower spring guide 20, in which pilot pin 19 is positioned, and an upper spring guide 22 positioned non-rigidly thereto, as illustrated in FIG. 2. The spring guides 20, 21 comprise two telescoping parts. The upper, sleeve part 22 is pivotally accommodated in upper seat bearing 4.

The adjustable lock of the lower spring guide 20 takes place when, in the course of pivoting lever 16 in arrow direction 38 (see FIG. 1), bracket 36 pivots around the fulcrum of axle 17 and the slot herewith shifts crosswise toward the longitudinal axis of the helical spring. As a result, the contact point of pressure spring 21 on the backrest support is changed because the entire end of spring guide 20 now pivots in arrow directions 33 (FIG. 2). This pivoting in arrow direction 33 is therefore only possible because backrest support 1 has not yet pivoted in arrow direction 34.

Figure 6:
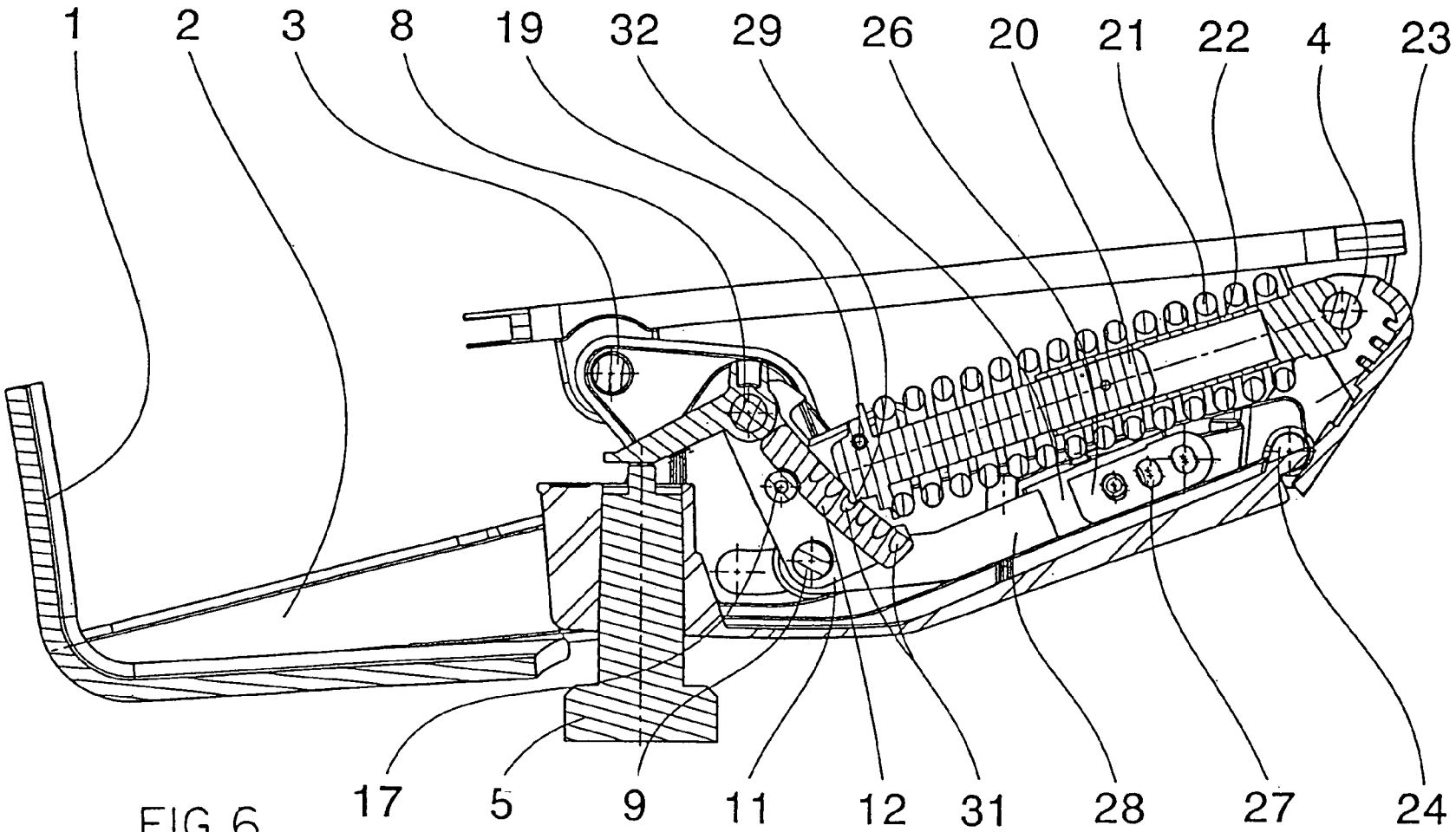
FIG. 6 is a view similar to FIG. 2, but with the backrest bar lowered and a latched adjusting mechanism.

If the contact point of pressure spring 21 searched for was found on the backrest support by shifting lever 16, the backrest support may be pivoted backwards in any position 1 in arrow direction 34. This pivoting ensures that the interlocking element having toothed rack 12 pivots counterclockwise around bearing 8, and while doing so, a catching recess 31 positioned on toothed rack 12 is forced into engagement with an allocated tooth 32 on the lower spring guide 20 of the energy storing device. As a result, the energy storing device locks with the backrest support, and the considerable advantage is that when the backrest support is swiveled down, the energy storing device impinges on backrest support 1 with a previously preselected force and it is herewith possible to previously adjust a desired restoring force for the backrest support (FIG. 6).

When pivoting the backrest support to its position of rest, as per FIG. 1 and FIG. 2, the previously described engagement between interlocking element 10 and tooth 32 of spring guide 20 disengages, so that another pivoted position of pressure spring 21 with respect to bracket 2 may now be chosen via lever 16. This means that, in a balanced backrest support, tooth 32 may be engaged in any catching recess 31 on interlocking element 10.

Figure 5:
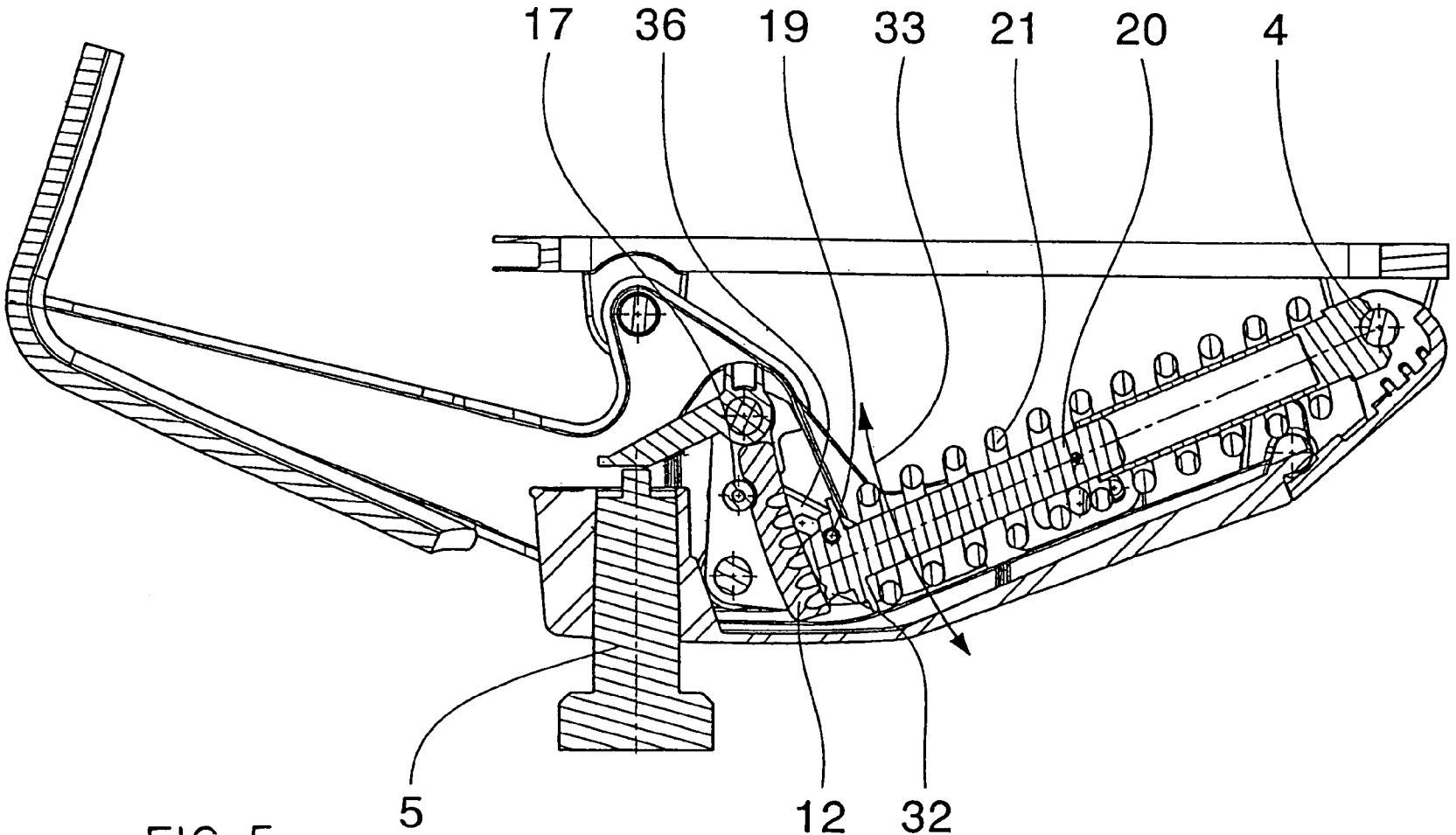
FIG. 5 is a sectional view similar to FIGS. 2 and 4, illustrating a third tensioning position of the adjustment mechanism at the strongest adjustment of the restoring force.

If, for example, an upper tooth is used for the engagement, backrest support 1 is prestressed only with a slight pre-set tension (tensioning position according to FIG. 4), whereas when a lower tooth 32 on the lower end of the interlocking element is used for the engagement, the energy storing device acts on backrest support 1 with a high pre-set tension (tensioning position according to FIG. 5). FIG. 2 shows an average tensioning position.

The important thing here is that the energy storing device itself only needs to be equipped with a relatively small-dimensioned pressure spring 21 because an additional pre-stress of the pressure spring by pivoting guide bar 23 upwards in arrow direction 35 still takes place when the backrest support is pivoted backwards in arrow direction 34. Upper spring guide 22 is still pressed against lower spring guide 20 in this manner, as a result of which pressure spring 21 is compressed even further, thereby increasing the spring resistance.

For the sake of completeness, it should also be mentioned that there is a turning pushbutton 25 on seat support 7 for the height adjustment of air column 5.

Furthermore, it should be mentioned that there is a turning pushbutton, not illustrated further, for locking the swiveling movement of the backrest, and consequently, of backrest support 1. This locking is effected by a longitudinal lever 28 directed forwards being connected to interlocking element 10, the longitudinal lever forming a front guide recess 29 for the length guide of a stopping plate 26 positioned there in a non-rigid manner.

A series of boreholes 27 lying one after the other are positioned in stopping plate 26, and the locking of the backrest support in any pivoted position is possible because a spring-loaded pressure pin (plunger pin or index pin) may catch through the stopping plate 26, as a result of which a connection between interlocking element 10 and the allocated backrest support 1 is established in the region of seat support 7. Thus, backrest support 1 is rigidly coupled to seat support 7 and the backrest support may, as a result, no longer be pivoted in arrow direction 34 and in the opposite direction thereto. Stopping plate 26 moves similarly to the swiveling movement of the backrest support in arrow directions 34 and in the opposite direction thereto, as shown by arrow direction 30 in FIG. 2.

The spring-loaded plunger pin (not shown graphically) sits on the seat support in a region of the front borehole. If backrest support 1 is pivoted in a halfway swung-out lowered position and then stopped, a borehole 27 in stopping plate 26 ends up aligned flush with a front borehole on the seat support, so that the retention pin is now inserted into the central borehole of the stopping plate. On the other hand, should the backrest support be stopped in a greatly swung-out position, the very last borehole in stopping plate 26 ends up forwards, where in the drawing according to FIG. 2, the frontmost borehole on the seat support is shown, and the spring-loaded pressure pin then catches in this opposite placement of borehole 27 and the borehole, not illustrated further, in the seat support.

Although an exemplary embodiment of the invention has been described above by way of example only, it will be understood by those skilled in the field that modifications may be made to the disclosed embodiment without departing from the scope of the invention, which is defined by the appended claims.

We claim:

1. A working chair with adjustable backrest support pre-set tension, comprising:

a seat comprising a seat support and a seat plate supported above the seat support, the seat support and seat plate each having a forward edge;

a first pivot at the forward edge of the seat support and a second pivot at the forward edge of the seat plate;

a backrest support having an end part pivotally connected to the seat support;

an energy storing device for biasing the backrest support against the back of a seated user;

a manually operable adjustment mechanism for adjusting a pre-set tension of the energy storing device;

a guide bar pivotally mounted between the first and second pivots;

the energy storing device having a front end and a rear end, the front end of the energy storing device being positioned on the guide bar and rotatably mounted on the second pivot and the rear end of the energy storing device adjustably engaging the end part of the backrest support at a contact point;

the contact point between the rear end of the energy storing device and the end part of the backrest support being adjustable;

the adjustment mechanism comprising an interlocking element positioned on the end part of the backrest support, the interlocking element being adapted to be forced into engagement with the energy storing device.

2. The chair as claimed in claim 1, wherein the interlocking element comprises a toothed rack having a plurality of catching recesses facing the energy storing device, the energy storing device comprising a spring and a spring guide extending through the spring having a front end and a rear end, the adjustment mechanism further comprising a tooth on the rear end of the spring guide for engagement in a selected catching recess of the toothed rack.

3. The chair as claimed in claim 2, further comprising an index pin on the rear end of the energy storing device, the adjustment mechanism having an indexing track into which said index pin engages, the engagement between said index pin and track bringing the tooth of the spring guide opposite a catching recess of the toothed rack.

4. The chair as claimed in claim 1, wherein the contact point of the energy storing device on the end part of the backrest support is manually adjustable.

5. The chair as claimed in claim 1, wherein the energy storing device comprises a spring.

6. The chair as claimed in claim 1, wherein the adjustment mechanism comprises an externally accessible operating lever rotatably mounted on the end part of the backrest support adjacent the rear end of the energy storing device, a bracket rigidly connected to the operating lever and having a slot, the energy storing device having a spring guide which is non-rigidly guided in said slot.

7. The chair as claimed in claim 1, wherein the interlocking element is self-locking.

8. The chair as claimed in claim 1, wherein the energy storing device comprises a spring guide and a spring mounted on the spring guide, the spring guide being adjustable in length as a result of pivoting movement of the guide bar, whereby the spring is additionally prestressed by said adjustment of said spring guide.

9. The chair as claimed in claim 1, wherein the engagement of the energy storing device with the end part of the backrest support is pre-positioned.

10. The chair as claimed in claim 1, wherein the engagement between the rear end of the energy storing device and the end part of the backrest support is stepless.

* * * * *